US006131622A

United States Patent [19]

Fritze et al.

[11] Patent Number: 6,131,622

[45] Date of Patent: Oct. 17, 2000

[54] SINGLE STAGE AREA BULK FOOD DISPENSER METHOD AND APPARATUS

[75] Inventors: Karl J. Fritze, Denmark Township; Bruce H. Koerner, Red Wing; Ferdinand J. Herpers, Minnetonka; Kirby J. Kuhlemeier, Cottage Grove, all of Minn.

[73] Assignee: Robot Aided Manufacturing Center, Inc., Red Wing, Minn.

[21] Appl. No.: 08/961,283

[22] Filed: Oct. 30, 1997

[51] Int. Cl.[7] ..... B65B 1/04

[52] U.S. Cl. ..... 141/196; 141/129; 141/83; 141/192

[58] Field of Search ..... 141/196, 192, 141/129, 83, 98; 222/56, 58, 77; 221/158, 224, 225, 236

[56] References Cited

U.S. PATENT DOCUMENTS

| | | | |
|---|---|---|---|
| D. 337,021 | 7/1993 | Boetto . | |
| D. 402,853 | 12/1998 | Fritze et al. . | |
| 3,985,266 | 10/1976 | Wright, Jr. | 141/83 |
| 4,922,435 | 5/1990 | Cahlander et al. . | |
| 4,979,864 | 12/1990 | Cahlander et al. . | |
| 5,104,002 | 4/1992 | Cahlander et al. . | |
| 5,132,914 | 7/1992 | Cahlander et al. . | |
| 5,172,328 | 12/1992 | Cahlander et al. . | |
| 5,191,918 | 3/1993 | Cahlander et al. . | |
| 5,244,020 | 9/1993 | Bruno et al. | 141/83 |
| 5,249,914 | 10/1993 | Cahlander et al. . | |
| 5,282,498 | 2/1994 | Cahlander et al. . | |
| 5,353,847 | 10/1994 | Cahlander et al. . | |
| 5,778,767 | 7/1998 | Rudesill . | |

OTHER PUBLICATIONS

RAM Center, Inc., Brochure for RAM Center ARCH® Fry Dispenser, 1994 (Exhibit A).

RAM Center, Inc., Brochure for ARCH® 280 Fry Dispenser, 1995 (Exhibit B).

*Primary Examiner*—Steven O. Douglas

*Attorney, Agent, or Firm*—Merchant & Gould P.C.

[57] ABSTRACT

A method and apparatus are provided for dispensing articles into a manually placed receiving basket and for controlling the dispensing mechanism to more accurately dispense the desired articles. The dispenser 20 includes a main storage area 39 which can take the form of a bulk storage hopper, an accumulator area 36 into which the dispensed articles are transferred during the "gravimetric" dispensing of the articles. The accumulator area 36 may be formed from the same externally formed walls of the primary storage area 39 and hopper 21. An assembly for controllably transferring articles from the primary area 39 to the accumulator area 36 is also provided. This controllable transfer assembly may include a drum 51 having a plurality (or series) of elevated areas 52 about the circumference 53 of the drum 51, a diverter shape 54 located in the primary storage area 39, and an incline slope shape 37 leading down to the drum 51. A drive assembly 159 is provided to rotate the drum 51 when transferring articles. The articles in the accumulator area 36 are retained in that area by doors 32 of a gate assembly. The gate assembly are selectively operated between open and closed positions. A load cell 165 comprising a weight sensing assembly is arranged and configured to weigh the articles retained by the gate assembly. A controller 152 monitors the load cell 165 and operates the drive assembly 159 to control the articles dispensed into the accumulator area 136 to a predetermined level. By monitoring the movement of the drum 51 and the weight of the transferred articles, the controller 152 can determine the manner in which the drum 51 might be moved in a future dispensing cycle to increase the accuracy of the dispensed articles.

17 Claims, 8 Drawing Sheets

SINGLE STAGE AREA BULK FOOD DISPENSER METHOD AND APPARATUS

FIELD OF THE INVENTION

This invention relates generally to dispensing; more particularly to dispensing food items; and more particularly still to dispensing frozen food items into a food dispensing area with a manually placed cooking basket.

BACKGROUND OF THE INVENTION

Frozen french fry dispensers are known in the art. An example is disclosed in U.S. Pat. No. 5,282,498 issued to Cahlander et al; U.S. Pat. No. 5,353,847 issued to Cahlander et al; and U.S. Pat. No. 5,191,918 issued to Cahlander et al. Each of the foregoing patents discloses a french fry dispenser which includes a main storage bin, a device for moving the fries from the main storage bin into a secondary location, a means for holding the fries in the secondary location, and a complex apparatus for moving empty cooking baskets into position under the secondary storage location.

While the disclosed dispenser automates the process of dispensing frozen articles and has been successful in the marketplace, there are several areas in which the dispenser may be improved. First, the complex apparatus used for automatically moving the plurality of baskets into position under the secondary position is often not needed and/or desired by the end-user. Further, in such instances, providing such a device introduces unnecessarily complex and expensive equipment into the dispenser. Second, the manner in which the disclosed apparatus determines the weight of the articles to dispense does not provide highly accurate results (e.g., dispensing by time and by volume may be non-linear based in part upon the articles dispensed).

Therefore, there arises a need in the art for a simplified dispenser which is capable of dispensing a plurality of articles from a main storage bin into a receiving bin, and then into a manually placed basket for subsequent cooking. Such apparatus should also provide for accurate weighing by taking into account differences in the individual dispenser and articles dispensed and which over time learns to account for such discrepancies.

SUMMARY OF THE INVENTION

The present invention provides for a reliable method and apparatus for dispensing articles and controlling the dispensing mechanism to more accurately dispense the desired articles. Such control may also be expanded to learn over time to modify the control to achieve even greater accuracy.

In a preferred embodiment constructed according to the principles of the present invention, the apparatus includes a main storage area which can take the form of a bulk storage hopper, an accumulator area into which the dispensed articles are transferred during the "gravimetric" dispensing of the articles. What is meant by gravimetric is that a quantity of articles is transferred to the accumulator area, where the transferred mass is weighed.

The accumulator area may be formed from the same externally formed walls of the primary storage area. A means for controllably transferring articles from the primary to the accumulator area is also provided. The controllable transfer means may include a drum having a plurality (or series) of elevated areas about the circumference of the drum and a diverter shape located in the primary storage area. A drive means is provided to rotate the drum when transferring articles.

The articles in the accumulator area are retained in that area by a gate means. The gate means are selectively operated between open and closed positions. Weight sensing means are arranged and configured to weigh the articles retained by the gate means in real time. A controller monitors the real time signal of the weight sensing means and operates the drive means to control the articles dispensed into the accumulator area to a predetermined level. It will be appreciated that the gate means may be selectively opened automatically upon reaching the desired weight or may be operated by a user when desired.

One feature of the present invention is that by monitoring the movement of the drum and the weight of the transferred articles, the controller can determine the manner in which the drum might be moved in a future dispensing cycle to increase the accuracy of the dispensed articles.

Therefore, according to one aspect of the invention, there is provided an apparatus for dispensing food articles from a primary storage holding area to a cooking basket, consisting essentially of: a primary food article storage location; an accumulator food article storage location, the accumulator storage location including gate means arranged and configured to selectively open upon receipt of a gate open signal, wherein the food articles fall by gravity to a cooking basket shelf, generally located beneath the gate means, the cooking basket shelf being arranged and configured for receiving a manually placed cooking basket; means for controllably transferring the food articles from the primary to the secondary or accumulator storage location in response to a control signal; measuring means for weighing the food articles in the accumulator storage location and generating a weigh signal; means for initiating a dispense signal; and processing means for receiving the weigh signal, comparing the received weigh signal to a predetermined weigh value, and generating a control signal for the transferring means, the processing means further including means for receiving the dispense signal and generating a gate open signal.

According to another aspect of the invention, there is provided an apparatus for dispensing articles from a primary storage holding area, comprising: a primary article storage location; an accumulator storage location, the accumulator storage location including gate means arranged and configured to selectively open upon receipt of a gate open signal, wherein the articles fall by gravity to a shelf, generally located beneath the gate means; means for controllably transferring the articles from the primary to the accumulator storage location in response to a control signal; measuring means for weighing the articles in the accumulator storage location in real time and generating a weigh signal; means for initiating a dispense signal; and processing means for receiving the weigh signal, comparing the received weigh signal to a predetermined weigh value, and generating a control signal for the transferring means, the processing means further including means for receiving the dispense signal and generating a gate open signal, wherein the processing means accept the real time weigh signals and vary the control signal in accordance with predetermined parameters.

According to yet another aspect of the invention, there is provided A method of dispensing articles comprising the steps of: loading the articles into a primary article storage location; initiating a dispense signal; controllably transferring the articles to an accumulator storage location in response to a control signal, the accumulator storage location including gate means arranged and configured to selectively open upon receipt of a gate open signal, wherein the articles fall by gravity to a shelf, generally located beneath the gate means; weighing the articles in the accumulator storage location in real time and generating a weigh signal; receiving the weigh signal, comparing the received weigh signal to a predetermined weigh value, and varying the control signal; and generating a gate open signal.

While the invention will be described with respect to a preferred embodiment configuration and with respect to particular components, it will be understood that the invention is not to be construed as limited by such configurations or components. Further, while the preferred embodiment of the invention will be described in relation to dispensing frozen french fries and to the method applicable to using a controller to dispense at greater accuracy, it will be understood that the scope of the invention is not to be limited by this environment in which the preferred embodiment is described herein.

These and various other advantages and features which characterize the invention are pointed out with particularity in the claims annexed hereto and forming a part hereof. However, for a better understanding of the invention, its advantages and objectives obtained by its use, reference should be had to the drawings which form a further part hereof and to the accompanying descriptive matter, in which there is illustrated and described a preferred embodiment to the invention.

BRIEF DESCRIPTION OF THE DRAWINGS

Referring to the drawings wherein like numerals represent like parts throughout the several views.

DETAILED DESCRIPTION OF THE PREFERRED EMBODIMENT

Figure 1:
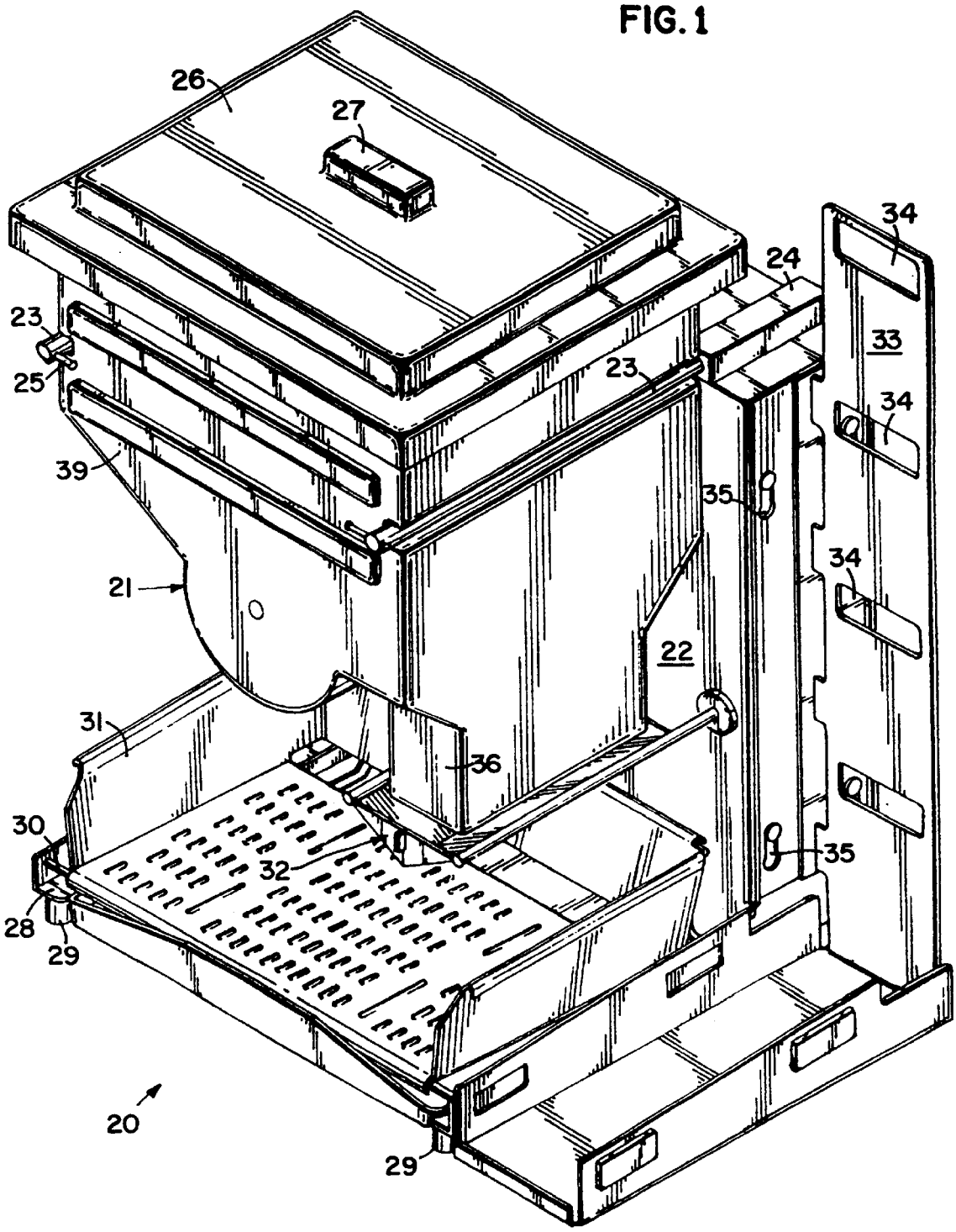
FIG. 1 is a perspective view of the dispenser of the present invention.
Figure 2:
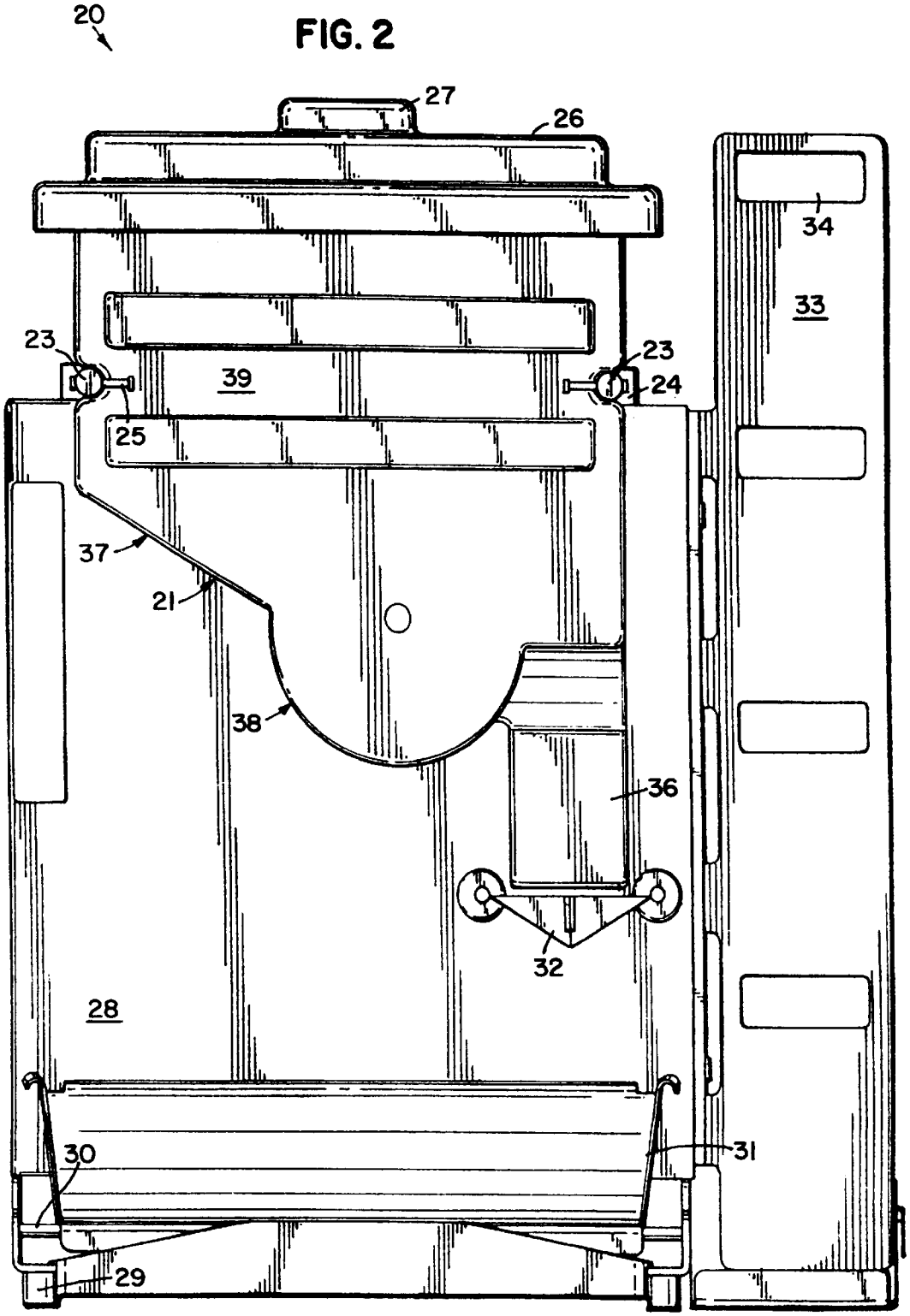
FIG. 2 is a front elevation view of the dispenser of FIG. 1.
Figure 3:
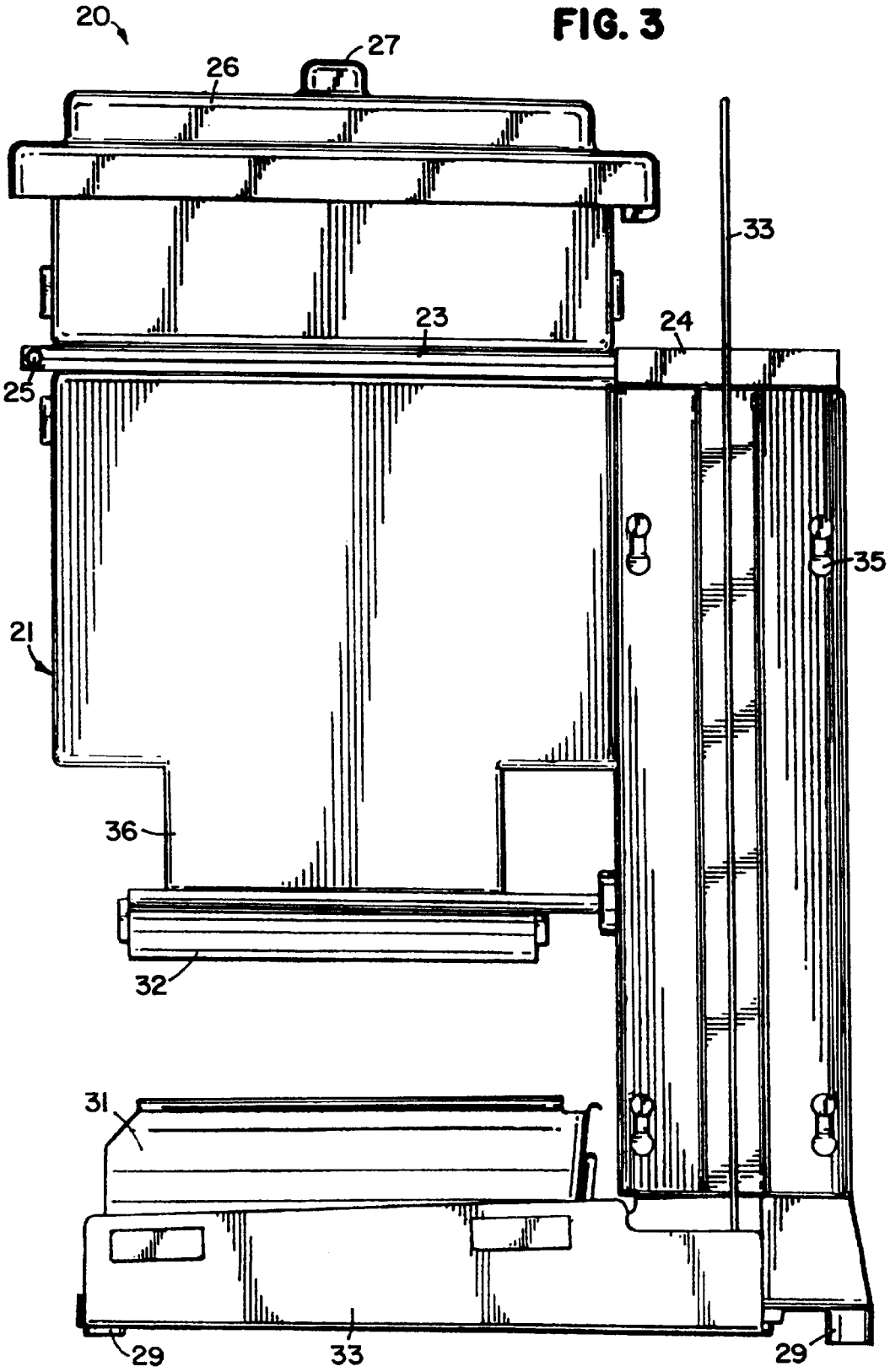
FIG. 3 is a right side elevation view of the dispenser of FIG. 1.

Turning now to FIGS. 1–3, there is illustrated a preferred dispenser designated by the number 20. The dispenser includes a plastic molded hopper 21 which is mounted onto a frame 28 via extension members 23. The extension members are slideably fit through integrally formed grooves in the sides of the hopper 21. Locking pin 25 is located on the distal end of extension member 23 to securely retain the hopper 21 on frame 28. The extension members 23 are secured to frame 28 at flanges 24.

The hopper 21 also includes a removable cover 26 with handle 27. The hopper 21 may be loaded with articles for dispensing with the cover 26 removed. The walls of the hopper 21 may also include a plurality of ribs integrally formed therein to provide additional strength and/or for aesthetic purposes.

The sides of frame 28 optionally include standoffs which cooperate with keyhole slots 35 on basket hanging frame(s) 33. The basket hanging frame 33 includes slots 34 defined therein, which slots 34 are arranged and configured to cooperatively interact with a hook member located on one end of the cooking baskets (best seen in FIG. 4). It should be noted that the standoffs may be included on either side depending on the left-hand or right-hand orientation of the dispenser 20. Mounting feet 29 are located at the bottom of the frame 28 and a vertical or upright portion 22 is located at the back of the frame 28.

The accumulator section 36 of the hopper 21 may be integrally formed (as can the area for the drum 38 and inclined area 37). Further, it will be appreciated that while the diverter 54 (best seen in FIG. 4) is a separate component in the preferred embodiment, the diverter 54 might also be integrally formed as part of the hopper 21. The gate means, or accumulator doors, 32 extend beneath the accumulator area 36 and will be described in more detail further below in connection with FIG. 5.

Bar 30 is provided for mounting a removable pan 31. Pan 31 helps keep dispensed articles which are accidently spilled within a confined area, and is preferably removable for ease of cleaning. The pan 31 also provides a location where individual baskets 50 (best seen in FIG. 4) may be stored prior to manually moving the basket below the gate means 32 for filling.

Figure 4:
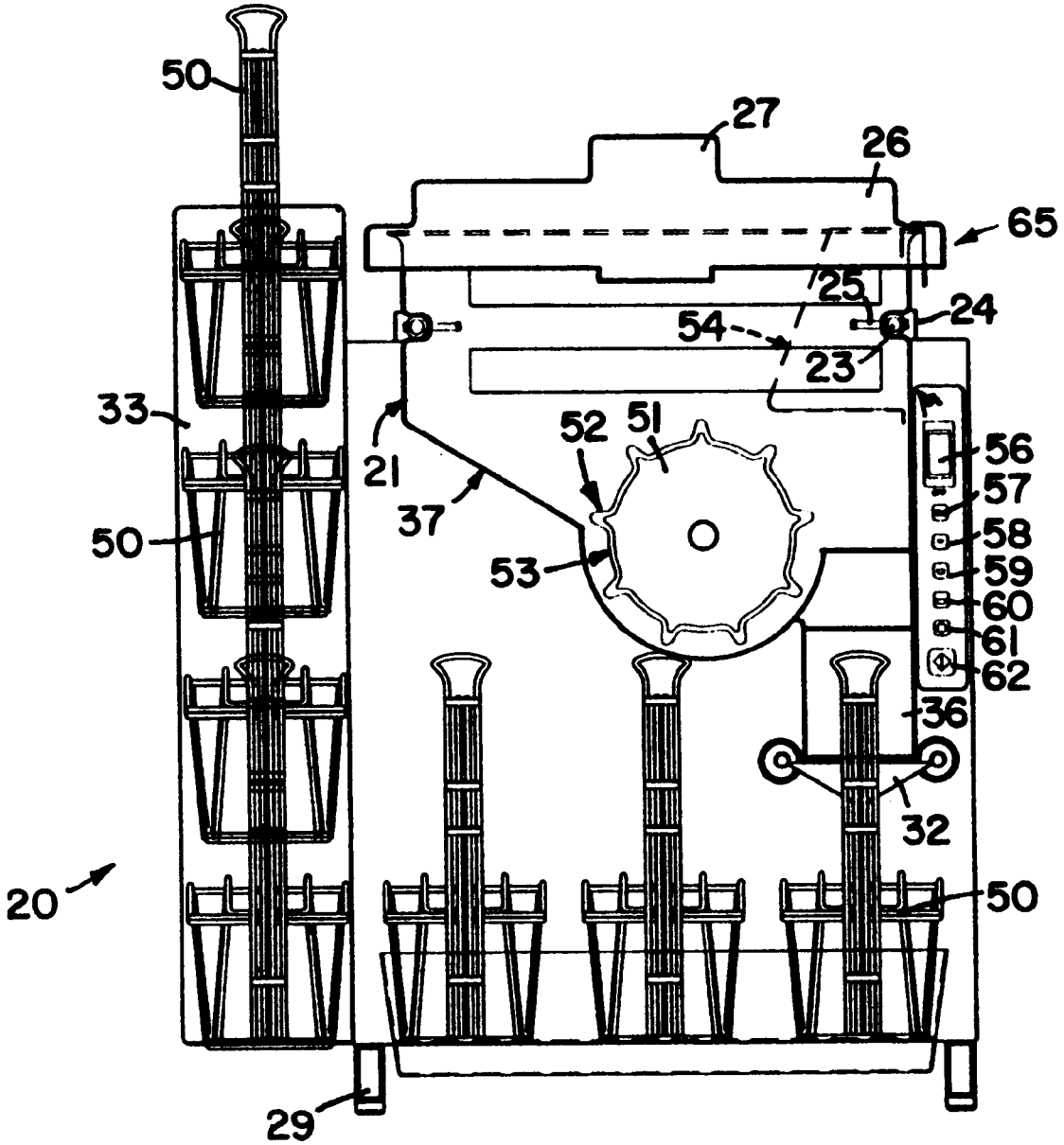
FIG. 4 is a diagrammatic front elevation view showing the location of the controllable transfer means including a drum and diverter, the user controls, and the wire cooking baskets (with the optional side mounting bracket located on the left side of the dispenser)

Next referring to FIG. 4, there is illustrated a diagrammatic dispenser 20 showing a plurality of baskets 50 located on the optional bracket 33. It will be appreciated upon reviewing the description of the dispenser 20 herein, that a controlled movement of the articles from the main or primary storage area 39 of the hopper 21 to an accumulator area 36 occurs. By placing the various components in relation to one another and by monitoring the speed and time of the movement, as well as the accumulated weight of the transferred articles, a very accurate dispensing operation can occur. Such accuracy improves efficiency, accuracy, and profitability in many cases. The location and interaction of the components which comprise the controllable moving means is also illustrated diagrammatically in FIG. 4.

The controllable moving means includes a diverter wall 54, a drum 51, and an incline slope 37. The incline slope 37 insures that as the amount of product within the bin 21 is depleted, the product tends to fall by gravity into the rotating drum 51. Preferably the incline slope 37 is molded integrally into the dispenser. However, the slope may be constructed of a removable member. The diverter wall 54 insures that product in the bin does not move into the accumulator area 36 absent rotation of the drum 51. In the preferred embodiment, the diverter wall 54 is constructed of a high grade of stainless steel and is removable. The wall 54 is arranged and configured with a flange 65 which hangs over the upper edge of the dispenser. In this manner, when the cover 26 is removed, then the wall 54 may be removed. The actual physical slopes of the inclined slope 37 and the diverter wall 54 may be found empirically for the articles which are being dispensed. In the preferred embodiment, the approximate slopes are 30 degrees from horizontal for the incline slope 37 and 21 degrees from vertical for the diverter wall 54. However, it will be appreciated by those of skill in the art that a larger slope decreases the amount of volume available for articles to be dispensed. Further, the type of material introduces a different coefficient of static friction (and sliding friction). Therefore, the surface area, shape, and material of the articles to be dispensed may dictate changes in the slopes of the preferred embodiment constructed in accordance with the principles of the present invention. The articles which are dispensed in the preferred embodiment described herein are frozen food articles, such as french fries and the like. However, other articles may be dispensed with the preferred dispenser.

The drum 51 is generally constructed in a can shape, with alternating raised areas 52 and land areas 53 about its circumference. The articles to be dispensed are moved by clockwise rotation of the drum 51 past the diverter wall 54, and into the accumulator area 36. The drum 51 is preferably mounted within the hopper 21 (in the area designated 38) on an axis. A motive means for providing the drum 51 rotation extends into the axis on the rear (not shown) of the hopper 21.

Also illustrated in FIG. 4 are the operator panel controls of the dispenser 20. On/off switch 56 controls power to the dispenser 20. Calibrate control 57 provides for a calibration sequence which is set forth in the following Table 1.

TABLE 1

1. Open gate means 32 (to insure that no load is on the doors)
2. Pause while load cell stabilizes—then take Tare reading
3. Close gate means 32, to accept the reference weight
4. Wait for a known reference weight to be located on the weighing sensor. If not applied within predetermined time, the calibration cycle aborts and the system moves to steady weighing/dispensing operation.
5. Pause while load cell stabilizes and take the reference reading
6. Wait for reference weight to be removed. Note: the dispenser is disabled until the weight is removed.
7. Weighing/dispensing operation resumes The controls designated 58, 59 and 60 provide for three different sizes of dispensed loads to be moved from the main hopper area into the accumulator area (e.g., small, medium, and large). Control 61 provides for an optional manual or automatic mode of operation. By way of example, this control button may be used when a photoelectric eye is located proximate the dispensing area below the gate means. Such an optional device provides an input to the operation of the gate means whereby opening the gate means cannot occur until a basket is placed in the dispensing area (e.g., beneath the accumulator area). Finally, control button 62 is the dispense switch for opening the gate means after a load of french fries is moved from the primary area 39 into the accumulator area 36.

Figure 5:
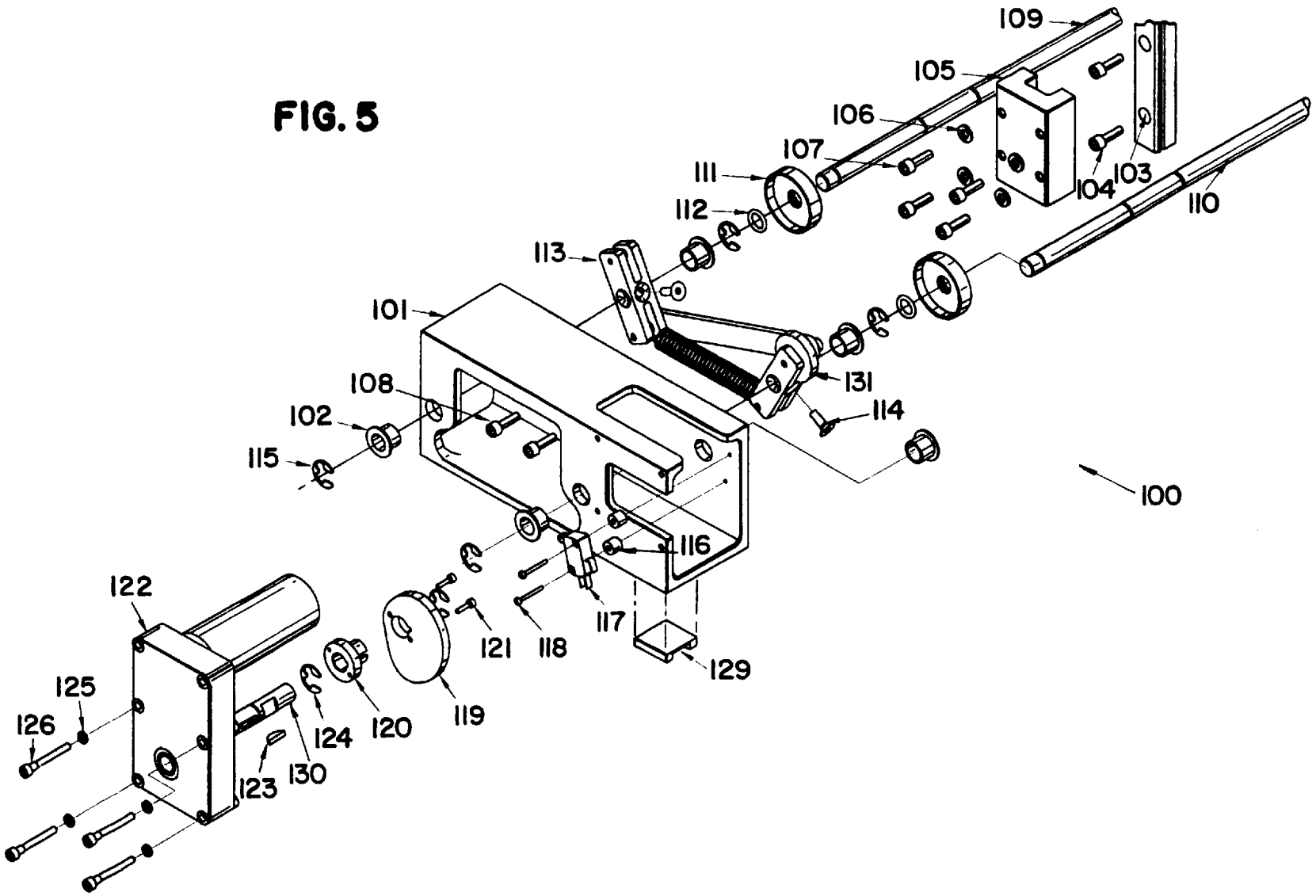
FIG. 5 is an exploded view of the gate means.

Turning now to FIG. 5, the mechanical construction and operation of the gate means for accumulator doors 32 is illustrated. The mechanical section 100 includes a housing 101 and an accumulator assembly linkage 113. Door rods 109 and 110 extend through shaft collars 111 and O-rings 112 (which help keep foreign matter from entering the enclosed area of upright portion 22) and are slidably inserted through holes on the link members of the linkage 113. A spring on the linkage 113 maintains the opposing link members in an orientation wherein the bottom ends are spatially oriented more closely to one another than their opposing top ends when in a first position (e.g., a door closed position). The door rods 109, 110 are rotatably coupled to the housing 101 via bushings 102, and are secured by retaining rings 115. The door rods 109, 110 rotate about their respective longitudinal axis when rotation of the link members of the linkage 113. The linkage 113 is secured to the rods 109, 110 with screws 114.

Motor 122 includes a gear head reducer and is mounted on the housing 101 via screws 126 and washers 125. The shaft 130 includes a key 123 which is cooperatively inserted into hub 120. The cam 119 is mounted on hub 120 via screws 121. The hub 120 is located on the shaft 130 with key 123 and retaining rings 124.

In operation, rotation of the shaft 130 rotates cam 119 which interacts with the cam follower surface 131 of the linkage 113. The oblong cam 119 forces the tops of the members of the linkage 113 toward one another, thereby causes the rods 109 and 110 to rotate (i.e., the movement of the linkage 113 is about the longitudinal axis of the arms 109 and 110) to a second or open position. The spring forces the return of the rods 109, 110 to the first or closed position.

A microswitch 117 is also located on the housing 101 (secured with screws 118 and standoff 116). The microswitch 117 determines the home position of the cam 119.

Figure 6:
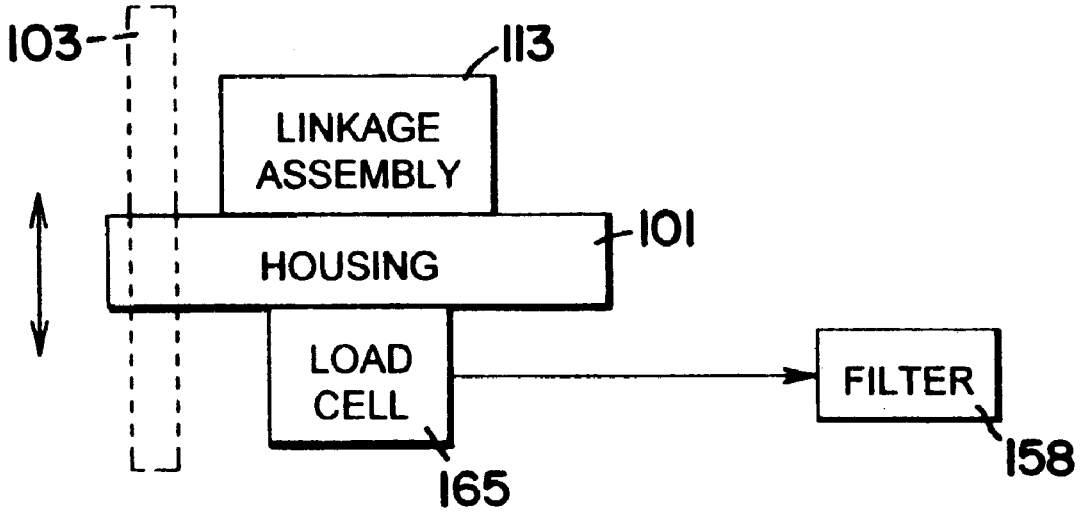
FIG. 6 is a functional block diagram of the components which slideably rest on the load cell.

The housing 101 is mounted on linear guide carrier 105 with screws 107 and washers 106. The linear guide 105 slideably mounts on rail 103 (which is secured to the dispenser frame 32 with screws 104), preferably with a ball bearing or other essentially frictionless mounting system. By mounting the housing 101 on the guide 105, the downward force (e.g., the weight) of the articles residing in the accumulator area 36 resting on the accumulator doors 32 is translated to the housing. A load cell 165 (best seen in FIG. 6) is located generally beneath the housing and generally along the path of the linear guide 105 (shown schematically in FIG. 6). The load cell 165 output provides for an accurate measurement of the articles to be dispensed. The measured load cell signal may then be processed to optimize the dispensing of repeatable, accurate loads. It will be appreciated that while the guide 105 is illustrated to one side of the center of the housing 101 in phantom in FIG. 6 (so as to differentiate the guide from the other components), such illustration is schematic in nature and the location may be varied.

Figure 7:
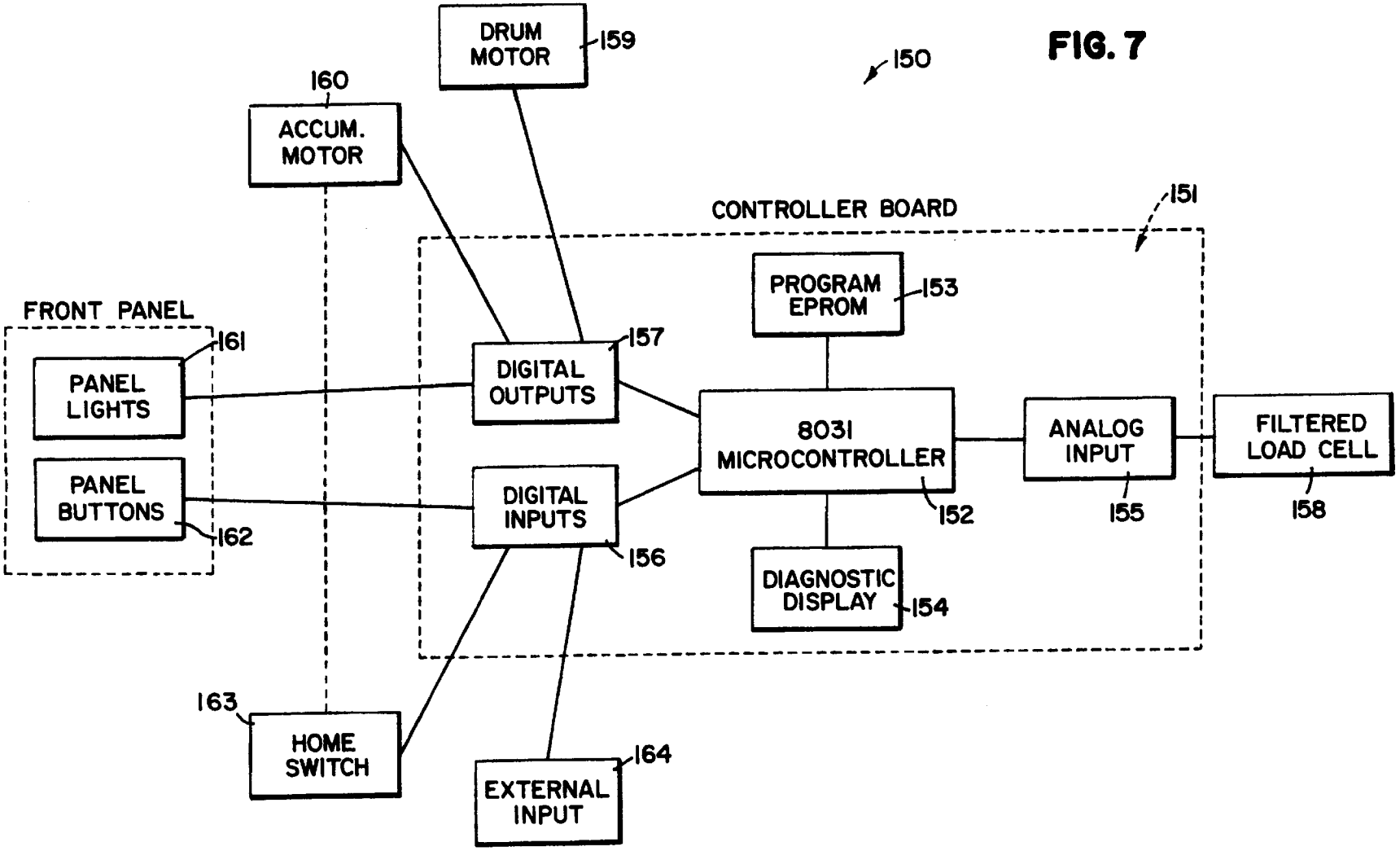
FIG. 7 is a functional block diagram of the controller and other electronic devices used in connection with the dispenser of FIG. 1.

Turning now to FIG. 7, there is illustrated a functional block diagram of the various electrical components which are utilized in connection with a preferred embodiment dispenser 20. The components are identified generally by the designation 150. A controller board 151 includes a microprocessor 152 preferably of the 8031 type or family. However, it will be appreciated that other microprocessors and controllers might be used to perform the operations and functionality of the dispenser 20 as described herein. For example personal computers such as Macintosh or IBM clones (of the 286, 386, 486 or Pentium chip set types) or personal computer motherboards might be used. The microprocessor 152 includes its own working memory.

For greater flexibility and programming upgrades, EPROM is included on the controller board 151 and is designated by functional block 153. An analog input 155 is provided for receiving filtered load cell data from block 158. Digital outputs 157 are connected to the accumulator motor functional block 160 (identified together with the shaft, reducer head, etc. by the designation 122 in FIG. 5), the primary mover or drum motor 159, and to the panel lights block 161. Digital inputs block 156 receives input from external input 164 (e.g., a remote dispense switch/button which may be mounted on the front of the dispenser 20), the home switch functional block 163 (identified by the designation 117 in FIG. 5), and the control block 162 (individually identified by the designations 57–62 in FIG. 4).

Finally, a diagnostic display 154 is provided as part of the controller board 151 for user diagnostic purposes.

Figure 8:
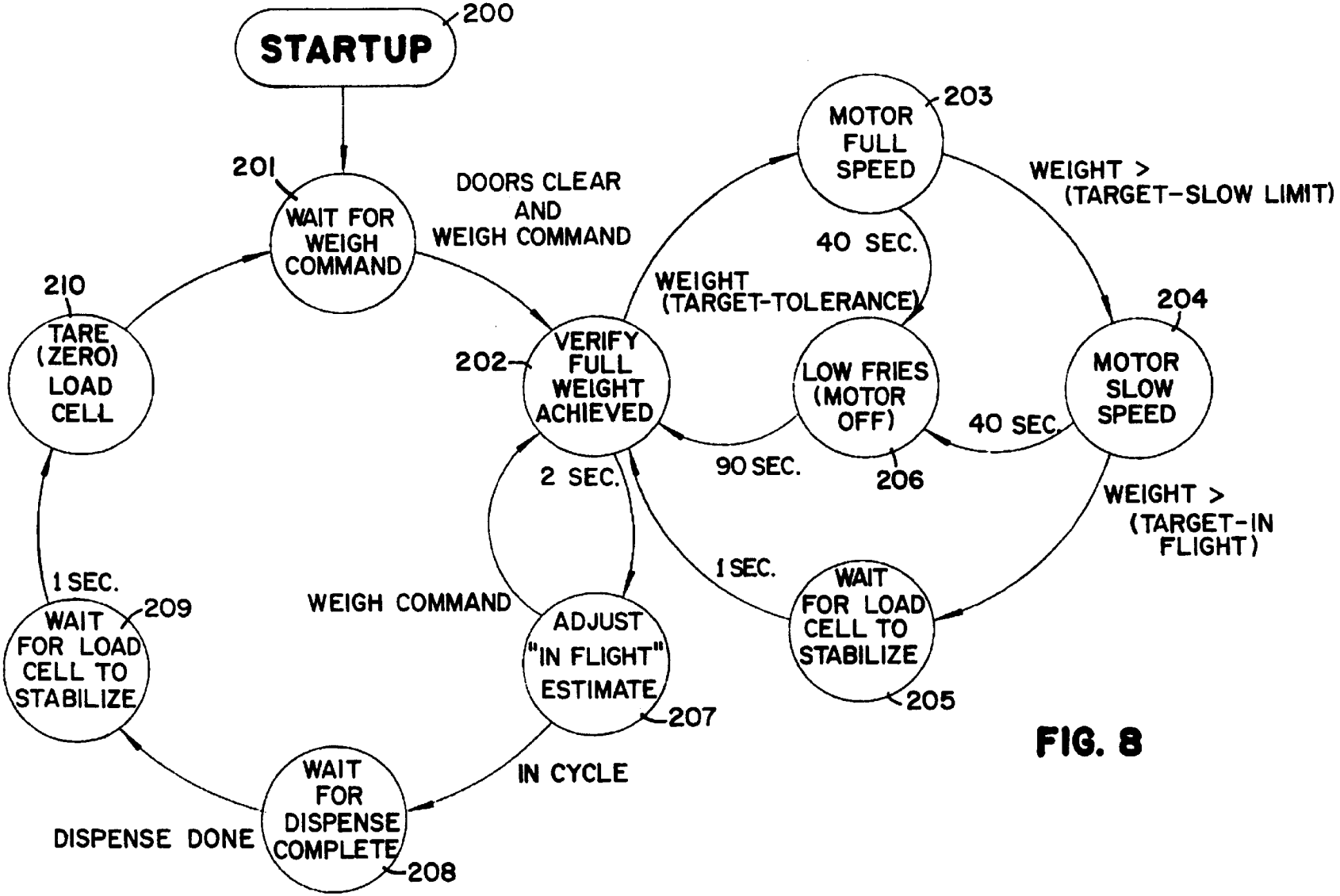
FIG. 8 is a state diagram for the operation of the dispenser.

Turning now to FIG. 8, a state machine diagram of the weighing process of the dispenser 20 is illustrated. As will be appreciated by those of skill in the art, the processor remains in a given state until one of the exit conditions is met. The exit condition(s) are set forth near the start of the arc leading to the appropriate next state. If no exit condition is described next to a given arc, then that arc is followed unless the exit condition for a different arc is met. In some cases, the exit condition is based on the processor having been in a given state for a predetermined period of time. In these instances, the time is described next to the arc (e.g., that arc will be followed if none of the other exit conditions are met before the time limit is reached).

The inputs to the state machine are all listed by the appropriate arcs. The outputs include the motor speed and an indication that the articles to be dispensed—in the present case frozen french fries—have been weighed (this is set in the same state as the one that adjusts the "in flight" estimate). Many states are not active processes, but instead represent "knowledge" of the process The definitions of the inputs are set forth in the following table 2.

TABLE 2

DOORS CLEAR—The accumulator doors are closed and not active.

WEIGH COMMAND—The sequencer is requesting a load be prepared, or the weight setting has changed.

WEIGHT—The filtered input from the Load Cell.

TARGET—The weight reading that is currently requested (the weight setting).

TOLERANCE—The permitted error—the preferred dispenser will retry if it is not met.

SLOW LIMIT—The dispenser switches to slow dispense when the weight gets within this amount of TARGET.

IN FLIGHT—An estimate of how much more product will be transferred to the accumulator area after the motor is turned off.

IN CYCLE—The dispenser is in the process of releasing product into a basket.

DISPENSER DONE—The fill cycle is complete and the gate means (doors) are closed.

The dispenser "Tares" the load cell by capturing the reading, this is subtracted from future readings to give the weight. The algorithm described herein may be made "adaptive" by modifying the maintenance of the "in flight" value. For example, this may be updated after each weighing by adding 1/10th of the final weight error. Additionally, a more advanced algorithm may include applying a similar technique in real-time to determine what the full speed of the motor should be. Essentially, the rate of weight gain would be compared to an ideal rate. If the current rate exceeded the desired rate, the motor drive would be reduced by an appropriate amount. The corrected rate would be stored for use in future weighings. The same would apply if the current rate was too slow. Here the motor drive would be increased to bring it up to speed. This would allow the dispenser to self adjust to products with different densities (e.g., poppers, french fries, mushrooms). The state machine diagram would not require extensive altering. However, the speed adjustment would performed continuously while in the "full speed" state. An additional adjustment of this could be done after the fact, at the same time the "in flight" estimate is being adjusted. A key item to perform this operation would be in storing the previous "full speed" value so that the adjusted value could be discarded in the case of an error (such as an empty condition).

In operation, the unit starts up at block 200 and moves to a wait for weigh command state at 201. If the doors are clear and the unit receives a weigh command, the state moves to state 202 to determine whether the full weight has been achieved. If the weight is less than target minus tolerance, the motor is brought to full speed at state 203 (until the weight is greater than target minus a slow limit speed). The process then moves to a state 204 wherein the motor is slowed to a secondary speed. At either state 203 or 204, if 40 seconds passes without moving to another state, a low fries condition is believed to have been met and the motor is turned off at state 206 (e.g., it is taking too long for the articles to be transferred into the accumulator area, and so therefore, not enough articles are present in the dispenser to operate properly).

At state 204, once the weight is greater than the target minus the current estimate of in-flight product, the processor moves to state 205 and waits for the load cell to stabilize. After one second, the processor returns to state 202 to verify that the weight is within tolerance. If no out of tolerance indication is received, then the processor moves to state 207. Here it waits until a weigh command is received (indicating that the target weight has been changed) or the gate means goes into cycle (indicating that a user has requested that a basket be filled). If the weigh command is received the processor returns to state 202 to verify that it has at least the new target weight. If the gate means has gone into cycle, it moves to state 208 and waits for the dispensing cycle to complete. When the dispensing cycle is complete, the processor moves to state 209 for the load cell to stabilize (e.g., after operation of the gate means). The processor then moves to state 210 to tare the load cell, and thereafter to state 201.

While a particular embodiment of the invention has been described with respect to its application for dispensing frozen french fries, it will be understood by those of skill in the art that the invention is not limited by such application or embodiment for the particular components disclosed and described herein. It will be appreciated by those skilled in the art that other circuit configurations that embody the principles of this invention and other applications therefor can be configured within the spirit and intent of this invention. The circuit configuration described herein is provided as only one example of an embodiment that incorporates and practices the principles of this invention. Other modifications and alterations are well within the knowledge of those skilled in the art and are to be included within the broad scope of the appended claims.

We claim:

1. An apparatus for dispensing food articles from a primary storage holding area to a basket, consisting essentially of:

a) a primary food article storage location;

b) an accumulator food article location arranged and configured proximate the primary food article storage location, wherein the food articles fall by gravity to a basket shelf, the basket shelf generally located directly beneath the accumulator location, the basket shelf being arranged and configured for receiving a manually placed basket;

c) means for controllably transferring the food articles from the primary to the accumulator location in response to a control signal;

d) means for initiating a dispense signal; and e) processing means for receiving the dispense signal and generating a control signal for the transferring means.

2. An apparatus for dispensing food articles from a primary storage holding area to a basket, consisting essentially of:

a) a primary food article storage location;

b) an accumulator food article storage location, the accumulator storage location including gate means arranged and configured to selectively open upon receipt of a gate open signal, wherein the food articles fall by gravity to a cooking basket shelf, generally located directly beneath the gate means, the basket shelf being arranged and configured for receiving a manually placed basket;

c) means for controllably transferring the food articles from the primary to the accumulator storage location in response to a control signal;

d) measuring means for weighing the food articles in the accumulator storage location and generating a weigh signal;

e) means for initiating a dispense signal; and f) processing means for receiving the weigh signal, comparing the received weigh signal to a predetermined weigh value, and generating a control signal for the transferring means, the processing means further including means for receiving the dispense signal and generating a gate open signal.

3. The apparatus of claim 2, wherein the measuring means includes a load cell.

4. The apparatus of claim 3, wherein the processing means zeroes the load cell prior to transferring the articles to the accumulator food article storage location, wherein accumulated tolerance differences in nominal part weights may be taken into account in order to optimize the weight of the transferred articles.

5. The apparatus of claim 2, wherein the transferring means includes:

a) a rotatable drum;

b) a diverter wall spatially located a predetermined distance above the drum; and c) an incline slope running into the side of the drum, wherein articles to be dispensed tend to migrate down the inclined slope toward the drum and articles above the drum are retained absent rotation of the drum.

6. The apparatus of claim 5, wherein the drum includes alternating raised and lowered areas running parallel with the longitudinal axis of the drum.

7. The apparatus of claim 5, wherein the transferring means includes a prime mover for rotating the drum.

8. The apparatus of claim 7, wherein the prime mover is a direct current motor.

9. The apparatus of claim 2, wherein the a primary food article storage location and the accumulator food article storage location are integrally formed within a single molded plastic shell.

10. The apparatus of claim 9, wherein the inclined slope is integrally formed from the single molded plastic shell.

11. An apparatus for dispensing articles from a primary storage holding area, comprising:

a) a primary article storage location;

b) an accumulator storage location, the accumulator storage location including gate means arranged and configured to selectively open upon receipt of a gate open signal, wherein the articles fall by gravity to a shelf, generally located directly beneath the gate means, the shelf being arranged and configured for receiving a manually placed basket;

c) means for controllably transferring the articles from the primary to the accumulator storage location in response to a control signal;

d) measuring means for weighing the articles in the accumulator storage location in real time and generating a weigh signal;

e) means for initiating a dispense signal; and f) processing means for receiving the weigh signal, comparing the received weigh signal to a predetermined weigh value, and generating a control signal for the transferring means, the processing means further including means for receiving the dispense signal and generating a gate open signal, wherein the processing means accept the real time weigh signals and vary the control signal in accordance with predetermined parameters.

12. The apparatus of claim 11, wherein the transferring means includes:

a) a rotatable drum;

b) a diverter wall spatially located a predetermined distance above the drum; and c) an incline slope running into the side of the drum, wherein articles to be dispensed tend to migrate down the inclined slope toward the drum and articles above the drum are retained absent rotation of the drum.

13. An apparatus for dispensing articles from a primary storage holding area, comprising:

a) a primary article storage location;

b) an accumulator storage location, the accumulator storage location including gate means arranged and configured to selectively open upon receipt of a gate open signal, wherein the articles fall by gravity to a shelf, generally located beneath the gate means;

c) means for controllably transferring the articles from the primary to the accumulator storage location in response to a control signal;

d) measuring means for weighing the articles in the accumulator storage location in real time and generating a weigh signal, the measuring means includes a load cell;

e) means for initiating a dispense signal;

f) processing means for receiving the weigh signal, comparing the received weigh signal to a predetermined weigh value and generating a control signal for the transferring means, the processing means further including means for receiving the dispense signal and generating a gate open signal, wherein the processing means accept the real time weigh signals and vary the control signal in accordance with predetermined parameters; and wherein the gate means are comprised of:

a) a pair of longitudinally opposing rods, each of the rods being rotatable about its longitudinal axis;

b) a pair of doors, each door being operatively mounted to a respective rod, wherein rotation of the rods translates to rotation of the doors;

c) a first and second opposing member, wherein each member is connected to one of the rods and the members are rotatable about the longitudinal axis of the rods, and wherein the members have a bottom end and a top end, the top end of the first member being connected to the bottom end of the second;

d) a spring connected between the bottom ends of the members for biasing the members into a first position which translates the doors into a closed position;

e) a cam follower located on the top end of the first member; and f) a cam means, wherein movement of the cam operates to move the top ends of the first and second members toward one another to a second position which translates into the doors in an open position.

14. The apparatus of claim 13, wherein the cam means is oblong and the movement of the cam means is rotational.

15. The apparatus of claim 14, wherein the gate open signal is directed to a motor which drives the cam.

16. A method of dispensing articles, comprising:

a) loading the articles into a primary article storage location;

b) initiating a dispense signal;

c) controllably transferring the articles to an accumulator storage location in response to a control signal, the accumulator storage location including gate means arranged and configured to selectively open upon receipt of a gate open signal, wherein the articles fall by gravity to a shelf, generally located directly beneath the gate means;

d) placing manually a basket on the shelf;

e) weighing the articles in the accumulator storage location in real time and generating a weigh signal;

f) receiving the weigh signal, comparing the received weigh signal to a predetermined weigh value, and varying the control signal; and g) generating a gate open signal.

17. An apparatus for dispensing food articles from a primary storage holding area to a basket, consisting essentially of:

a) a primary food article storage location;

b) an accumulator food article location arranged and configured proximate the primary food article storage location, wherein the food articles fall by gravity to a basket shelf, the basket shelf generally located directly beneath the accumulator location, the basket shelf being arranged and configured for receiving a manually placed basket;

c) a transferring member arranged to controllably transfer the food articles from the primary to the accumulator location in response to a control signal:

d) a member arranged to initiate a dispense signal; and e) a processor arranged to receive the dispense signal and generate a control signal for the transferring member.

* * * * *